US007449632B2

(12) United States Patent
Wang

(10) Patent No.: US 7,449,632 B2
(45) Date of Patent: Nov. 11, 2008

(54) WALL SWITCH WITH A SAFETY MODULE

(76) Inventor: Huei Fa Wang, No. 48, Lane 660, Jhongshan Rd., Sinhua Township, Tainan County 712 (TW)

( * ) Notice: Subject to any disclaimer, the term of this patent is extended or adjusted under 35 U.S.C. 154(b) by 0 days.

(21) Appl. No.: 11/693,075

(22) Filed: Mar. 29, 2007

(65) Prior Publication Data

US 2008/0006429 A1 Jan. 10, 2008

(30) Foreign Application Priority Data

Jul. 10, 2006 (TW) ..... 95212052 U

(51) Int. Cl.
*H01H 9/02* (2006.01)

(52) U.S. Cl. ..... 174/53; 174/66; 174/135; 174/60; 174/61; 439/95; 200/557

(58) Field of Classification Search ..... 174/66, 174/53, 135, 54, 60, 61; 200/557, 292, 293, 200/553, 339; 439/95, 108, 939, 535, 527
See application file for complete search history.

(56) References Cited

U.S. PATENT DOCUMENTS

| | | | | |
|---|---|---|---|---|
| 5,290,983 | A * | 3/1994 | Roberts et al. | 200/557 |
| 5,819,916 | A * | 10/1998 | Lee | 200/557 |
| 5,865,303 | A * | 2/1999 | Gernhardt et al. | 200/557 |
| 6,248,966 | B1 * | 6/2001 | Nakase et al. | 200/557 |
| 6,313,403 | B1 * | 11/2001 | Livingston et al. | 174/54 |
| 6,559,398 | B2 * | 5/2003 | Takeda et al. | 200/339 |
| 7,148,419 | B1 * | 12/2006 | Harrigan | 174/53 |

* cited by examiner

*Primary Examiner*—Dhiru R Patel
(74) *Attorney, Agent, or Firm*—Banger Shia

(57) ABSTRACT

The present invention discloses a wall switch with a current control safety module, includes a bottom seat, a triple-conductors assembly, a press-button assembly, a top cover, and a current control safety module. The current control safety module is structurally independent of other parts of the switch and operates via a fuse with a pre-set safety current threshold. The current control safety module makes an open circuit via a blown fuse when the current goes beyond the pre-set threshold.

5 Claims, 9 Drawing Sheets

(OFF)

(ON)

(OFF)

WALL SWITCH WITH A SAFETY MODULE

BACKGROUND OF THE INVENTION

1. Field of the Invention

This invention relates to a switch, and more particularly to a wall switch with a current control safety module, designed both for safety concern and for low maintenance demand.

2. Description of Prior Art

Wall switches are used commonly with lighting devices, hanging fans, or other electronic devices. Nevertheless, most conventional wall switches are not designed well enough to be protected from overload in current, causing safety problems. For instances, lighting devices are in general used for some sustained period of time; high temperature due to bad design in contact or low quality in conductive wires may cause the neighborhood of the contact or conductive wires to melt, resulting in a short circuit or a fire.

To look out for safety concern and outer appearance as well in lighting devices, most inventions resort to capacitors, printing circuit boards, etc. along with dozens of thin conductive wires, seriously effecting the efficiency of hear dissipation, damaging conductive wires, and possibly causing a short circuit.

For wall switches connected with fans or other electronic devices, a short circuit occurs when motor coils fail to cut off an overloaded current, which results when a fan motor is not operating smoothly.

Some wall switches are equipped with a safety module, comprising essentially a metal piece which deforms when heated and is thus expected to break the circuit. A disadvantage associated with such an invention lies in the fact that a variety of unexpected deformations may occur in the metal piece when heated, as a result, currents may still go through the metal piece despite its deformation. The second disadvantage of using a metal piece as a current controller in a circuit is the inconvenience in the replacement of a deformed metal piece, requiring a higher maintenance cost.

It is the goal of this invention to provide feasible solutions for problems discussed above. In particular, the present invention arises to solve some defects encountered in a prior art, stated in details below.

FIGS. 7 and 8 show a conventional wall switch, comprising mainly a bottom seat 1, two conductors 2 and 3, a press button device 4, and a top cover 5. Two compartments 11 and 12 are defined within the bottom seat 1 for receiving the conductor 2 and 3, respectively. Two wire through-channels 111 and 121 are configured under the compartments 11 and 12, respectively. Two separate external wires run though wire through-channels 111 and 121. The conductor 2 and 3 are separated by a partition space A, contacting each other; the partition space A stands in between the two opposing walls partitioning the two compartments of 11 and 12.

A silver alloy first contact 21 is disposed on the conductor 2, facing toward the partition space A. An extension 31 extends from the lower end of the conductor 3 towards the partition space A. An upside-down V-like ridge 311 protrudes from the extension 31.

The press button device 4 has a press block 41, a spiral spring 42, and a U-like conductors-assembly 43. The press block 41 is pivotally installed on the top cover 5. Underneath of the press block 41 is configured with a spring sleeve 411 to receive the top end of the spiral spring 42. The U-like conductors-assembly 43 stands in the partition space A for engaging with the lower end of the spiral spring 42, with its bottom floor 431 concave inwards, corresponding to the upside-down V-like ridge 311 (of the extension 31), as shown in FIGS. 7 and 8.

A silver alloy second contact 432 is disposed on one side of the U-like conductors-assembly 43 in a location to correspond to the silver alloy first contact 21 (of the conductor 2). FIG. 7 shows the switch in an OFF mode since there is no contact between the silver alloy first contact 21 and the silver alloy second contact 432. FIG. 8 shows the switch in an ON mode: when the press block 41 shifts, the spiral spring 42 moves the conductor 43 in a way that the silver alloy first contact 21 (of the conductor 2) meets the silver alloy second contact 432 (of the conductor 43).

The top cover 5 has a central opening to receive the press block 41 (of the press button device 4). The top cover 5 engages with the bottom seat 1 via fixing legs 52 thereof.

Having discussed a prior art close to the present invention, we proceed to detailed descriptions of the present invention and its patentable characteristics.

SUMMARY OF THE INVENTION

The present invention distinguishes itself from the above-discussed prior arts in that this invention comes with a current control safety module, which operates on a fuse of a pre-set current threshold, and makes an open circuit via a blown fuse when the current value goes beyond the pre-set threshold. In addition to an optimal safety concern, this invention also offers great convenience in maintenance. Since the current control safety module is structurally independent of the rest of the wall switch assembly, the safety module itself can be replaced easily without effecting the original layout of the wall switch assembly.

BRIEF DESCRIPTION OF DRAWINGS

These and other features and advantages of this invention will become apparent in the following description of a preferred embodiment of this invention, with reference to the accompanying drawing, in which.

DETAILED DESCRIPTION OF DRAWINGS

Figure 1A:
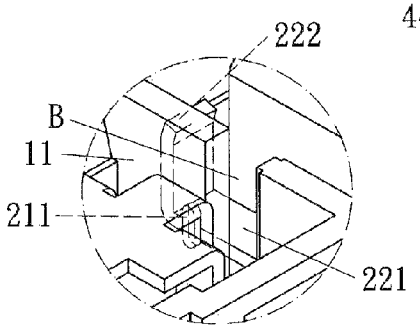
FIG. 1A is a partial enlargement of FIG. 1.
Figure 1:
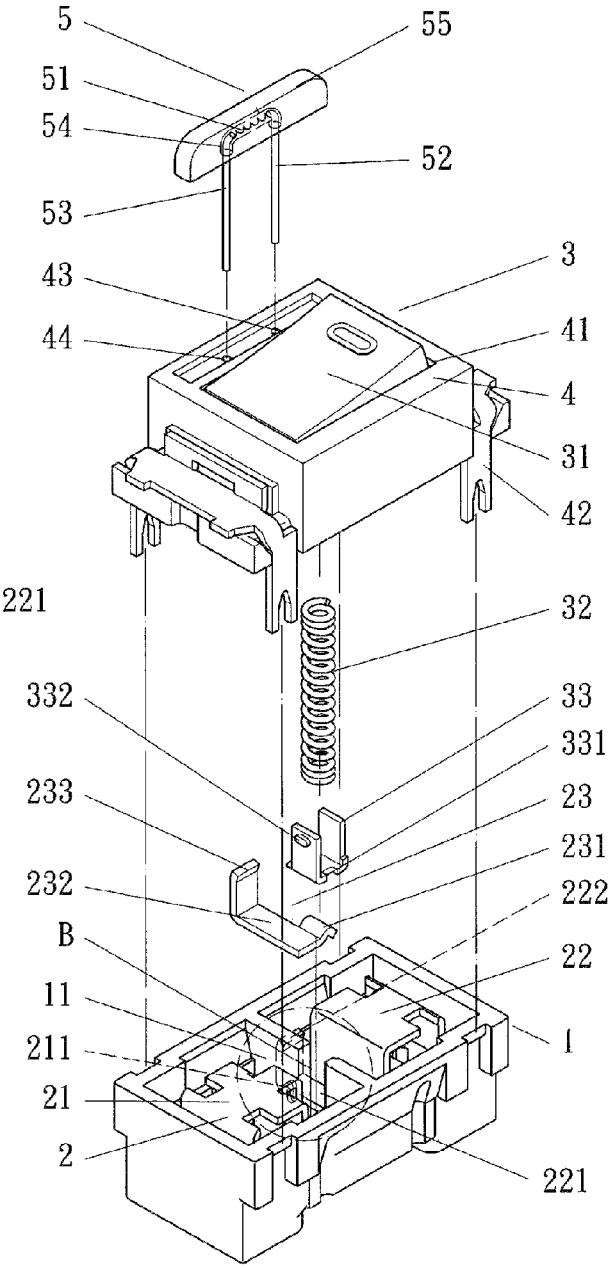
FIG. 1 is an exploded perspective view of the preferred embodiment in accordance with the present invention.
Figure 1B:
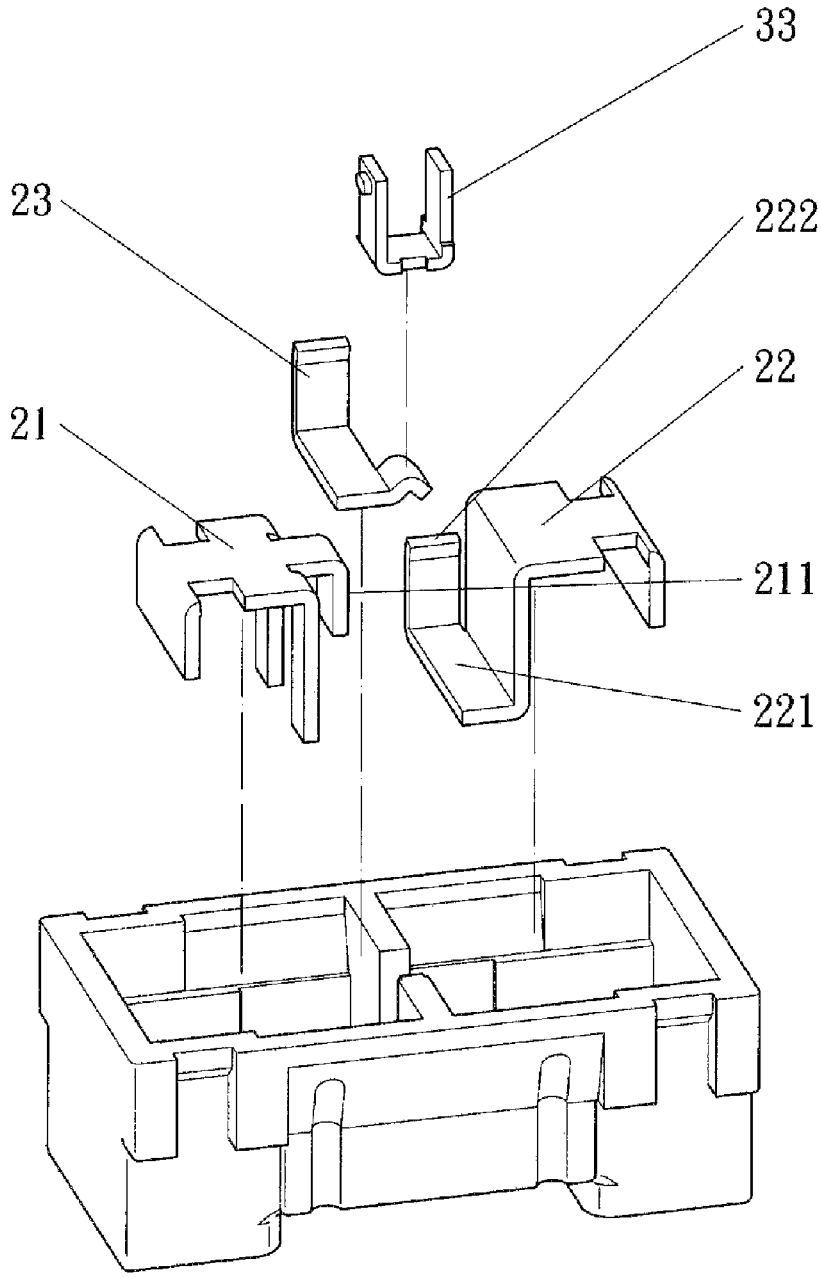
FIG. 1B is another partial enlargement of FIG. 1, with the lines showing locations of the conductors inside the bottom seat.
Figure 2:
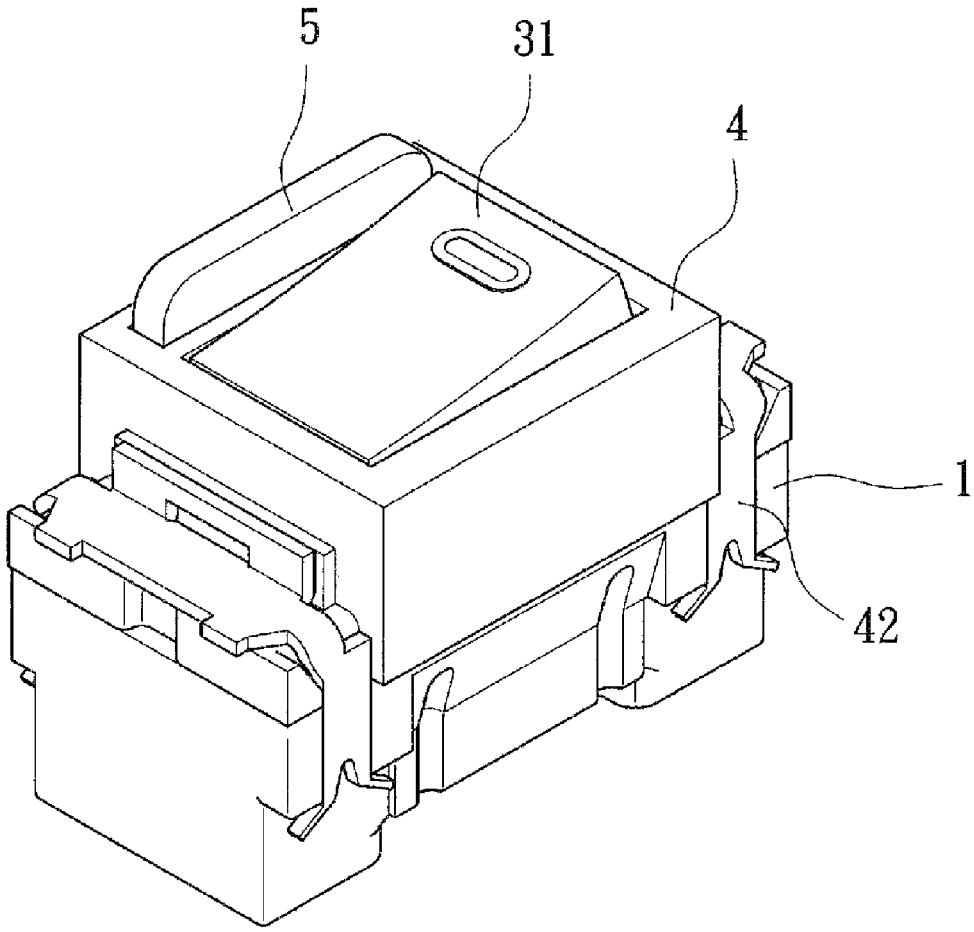
FIG. 2 is an assembly view of the preferred embodiment.
Figure 3:
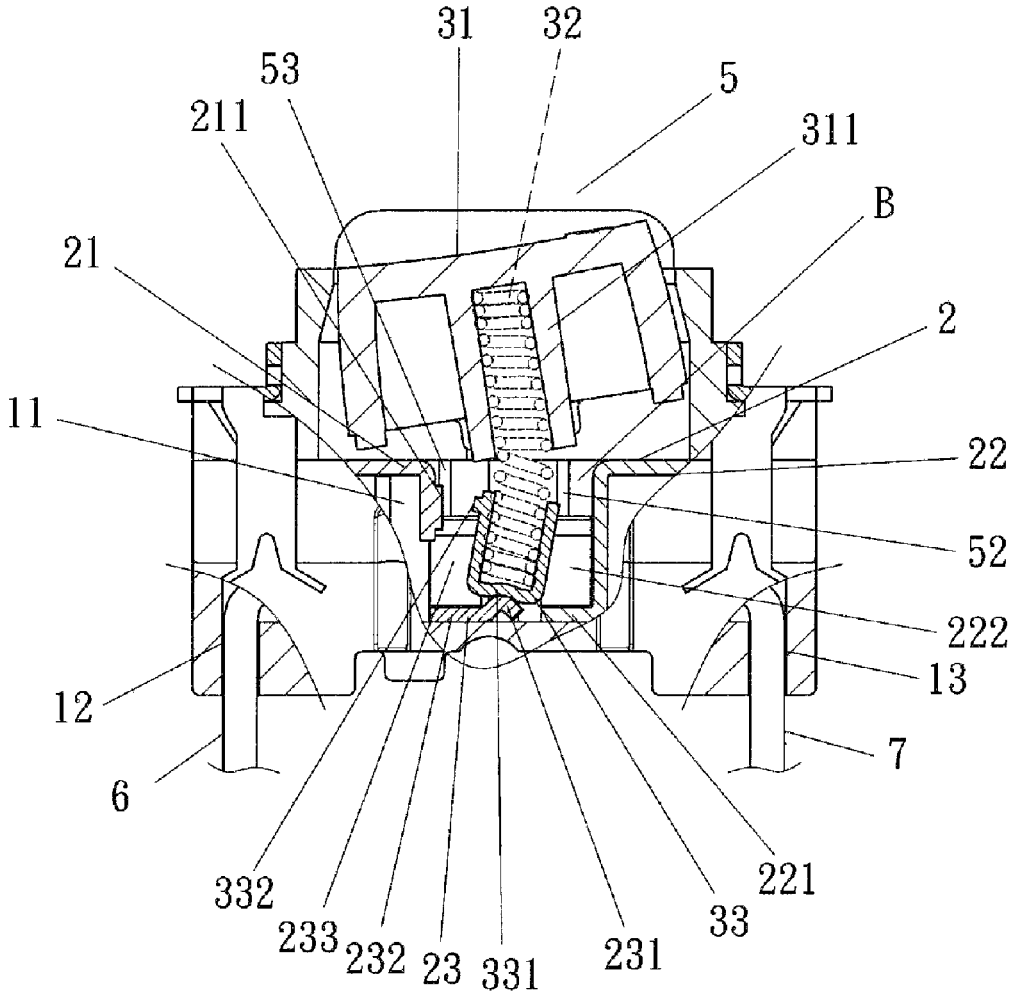
FIG. 3 is a cross-sectional view of the preferred embodiment in an OFF mode.

Referring to FIG. 1 to FIG. 3, a preferred embodiment of this invention comprises a bottom seat 1, a triple-conductors assembly 2, a press-button assembly 3, a top cover 4, and a current control safety module 5.

The bottom seat 1 comprises a triple-conductors-assembly receiver 11, and two wire through-channels, 12 and 13. The triple-conductors-assembly receiver 11 is configured with two compartments partitioned by two opposing walls (standing in between the two compartments) to accommodate the triple-conductors assembly 2. Along two sides of the bottom seat 1 are configured with two wire through-channels, 12 and 13, for an external wire 6 and wire 7 to run through, respectively, as shown in FIG. 3.

The triple-conductors assembly 2 includes a contact-controlled conductor 21, a fuse-controlled conductor 22, and an L-like bridge conductor 23. The contact-controlled conductor 21 and the fuse-controlled conductor 22 are each housed within the compartment separated by a partition space B in the triple-conductors-assembly receiver 11, as shown in FIG. 1. The contact-controlled conductor 21 and the fuse-controlled conductor 22 connect to an external wire 6 and 7, respectively. The L-like bridge conductor 23 links to the press-button assembly 3 via a U-like spring-controlled conductor 33.

Furthermore, on the side of the contact-controlled conductor 21 facing the partition space B, is disposed a silver alloy conductive first contact 211; while an extension 221 extends from the fuse-controlled conductor 22 in a direction toward the contact-controlled conductor 21 and parallel to the floor of the bottom seat 1, as shown in FIG. 1.*b*. A fuse-controlled conductor top 222, made of flexure materials, stands upright on top of one end of the extension 221 for engagement with the second conductive pillar 52.

The L-like bridge conductor 23 includes a bridge conductor head 233, a bridge conductor body 232, and a conductor leg 231, as shown in FIG. 1. The bridge conductor head 233 is made of flexure materials and stands upright on top of one end of the bridge conductor body 232; while the bridge conductor leg 231 extends from the lower lateral side of the conductive body 232, shaped like an upside-down V. In assembly, the L-like bridge conductor 23 is placed between the contact-controlled conductor 21 and fuse-controlled conductor 22 (in the triple-conductors-assembly receiver 11), not contacting neither the contact-controlled conductor 21, nor the fuse-controlled conductor 22. To be more specific, the bridge conductor leg 231 is positioned in the partition space B (between the two opposing walls separating the two compartments in the bottom seat 1). The L-like bridge conductor 23 and the fuse-controlled conductor 22 are arranged in such a way that the bridge conductor head 233 engages the first conductive pillar 53, and the fuse-controlled conductor top 222 engages the second conductive second pillar 52.

Figure 4:
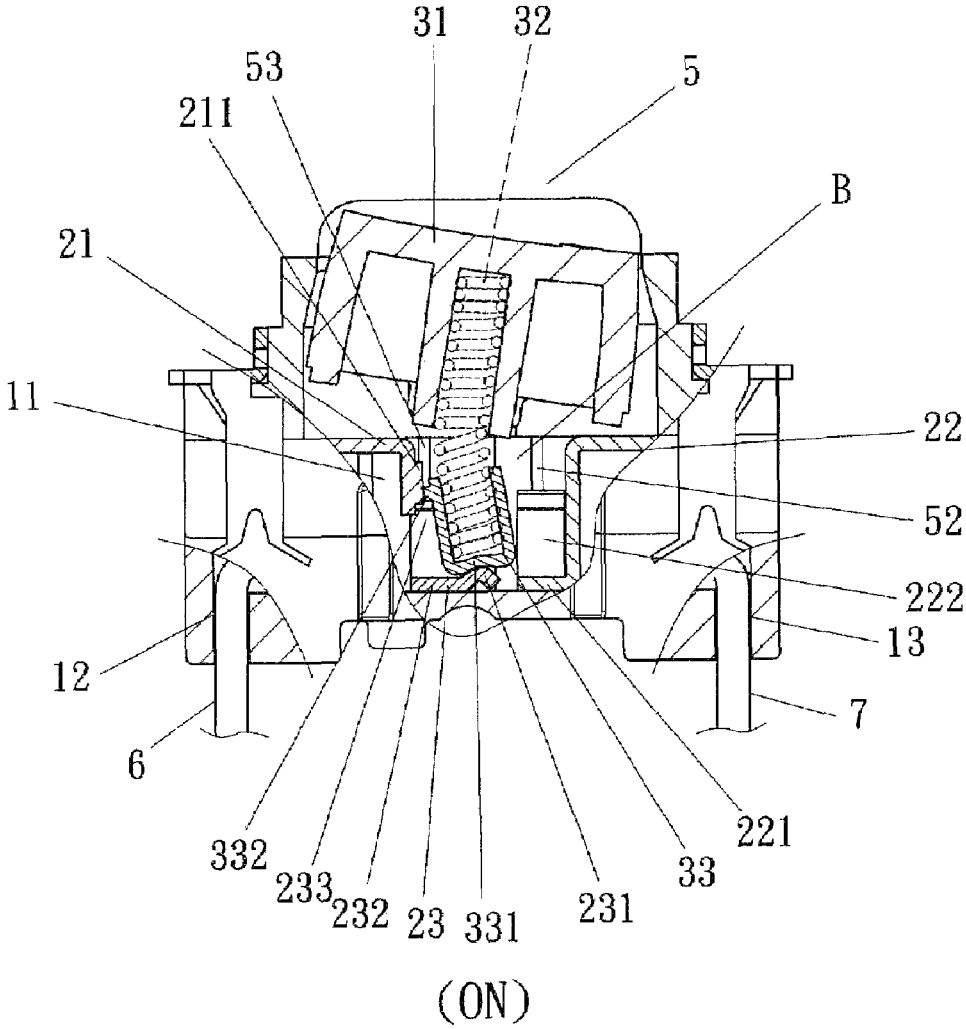
FIG. 4 is a cross-sectional view of the preferred embodiment in an ON mode.

The press-button assembly 3 comprises a press block 31, a spiral spring 32, and a U-like conductor 33. The press block 31, pivotally installed on the top cover 4, is configured with a spring sleeve 311 underneath for receiving the upper part of the spiral spring 32, as shown in FIG. 3. The U-like conductor 33 is positioned in the partition space B (between the two opposing walls separating the two compartments in the bottom seat 1), with its inner side connecting the lower end of the spiral spring 32. The U-like conductor 33 also comprises a recess 331, and a sliver alloy conductive second contact 332. As FIGS. 3 and 4 show, the recess 331 is made to adapt to and engage the bridge conductor leg 231 (of the L-like bridge conductor 23). Similarly, the sliver alloy conductive second contact 332 is configured to adapt to and engage the sliver alloy conductive first contact 211 (of the wired conductor 21).

The top cover 4 has a top opening 41 to receive the press block 31 (of the press button assembly 3), and seat-fixing legs 42 to engage the bottom seat 1. On the top of the top cover 4 are configured with two conductive-pillar insertion holes 44 and 43, whose positions correspond to the bridge conductor head 233 and the fuse-controlled conductor top 222, respectively.

The current control safety module 5 includes a fuse 51, two conducive pillars 52 and 53, a heat-tolerant insulating fuse sleeve 54, and a fuse cover 55. The fuse 51 is set to a predetermined safety current threshold, which will blow over an overload current and make an open circuit. Two ends of the fuse 51 are connected to the conductive pillars 52 and 53. The heat-tolerant insulating fuse sleeve 54 encloses the fuse 51 and the upper end of the conductive pillars 52 and 53. The fuse cover 55 is made of hard, heat-tolerant and insulating materials, which clothes inside the heat-tolerant insulating fuse sleeve 54, and the upper part of the first conductive pillar 53 and second conductive pillar 52.

Figure 5:
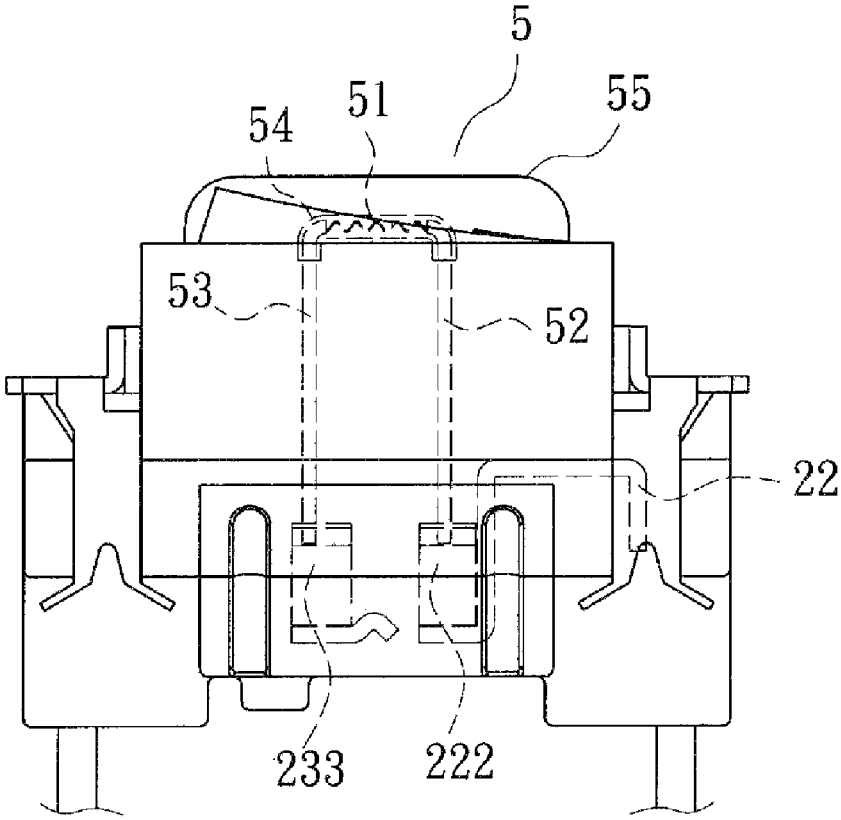
FIG. 5 is another cross-sectional view of the preferred embodiment in an ON mode.

Referring to FIG. 3, the recess 331 (of the U-like conductor 33) contacts against the bridge conductor leg 231 (of the L-like bridge conductor 23) via the elastic force of the spiral spring 32 within. The two external wires 6 and 7, extend through the wire through-channels 12 and 13, respectively, and connect the contact-controlled conductor 21 and the fuse-controlled conductor 22, respectively. Referring to FIG. 1, the conductive pillars 52 and 53 are installed inside the conductive-pillar insertion holes 43 and 44, respectively. As a result, the end of the conductive pillars 52 and 53 connect the fuse-controlled conductor top 222 (of the fuse-controlled conductor 22) and the bridge conductor head 233 (of the L-like bridge conductor 23), respectively (as shown in FIG. 5). FIG. 3 shows an OFF mode with no electric current running through the contact-controlled conductor 21 and the fuse-controlled conductor 22.

Referring further to FIGS. 4 and 5 for an illustration of the ON mode of the preferred embodiment of this invention. When the press block 31 (of the press button assembly 3) is pressed, the U-like conductor 33 (of the press button assembly 3) is shifted in such a way that the silver alloy conductive first contact 332 (of the U-like conductor 33 of the press button assembly 3) leans directly against the silver alloy conductive second contact 211 (of the contact-controlled conductor 21, the other end of which also connects to an external wire 6). A close electric circuit is contributed by the connection between the recess 331 (of the U-like conductor 33) and the bridge conductor leg 231, between the fuse-controlled conductor 233 and the first conductive pillar 53, between two conductive pillars 53 and 52 and the fuse 51, and between the second conducive pillar 52 and the fuse-controlled conductor 22, the other end of which also connects to an external wire 7.

Figure 6:
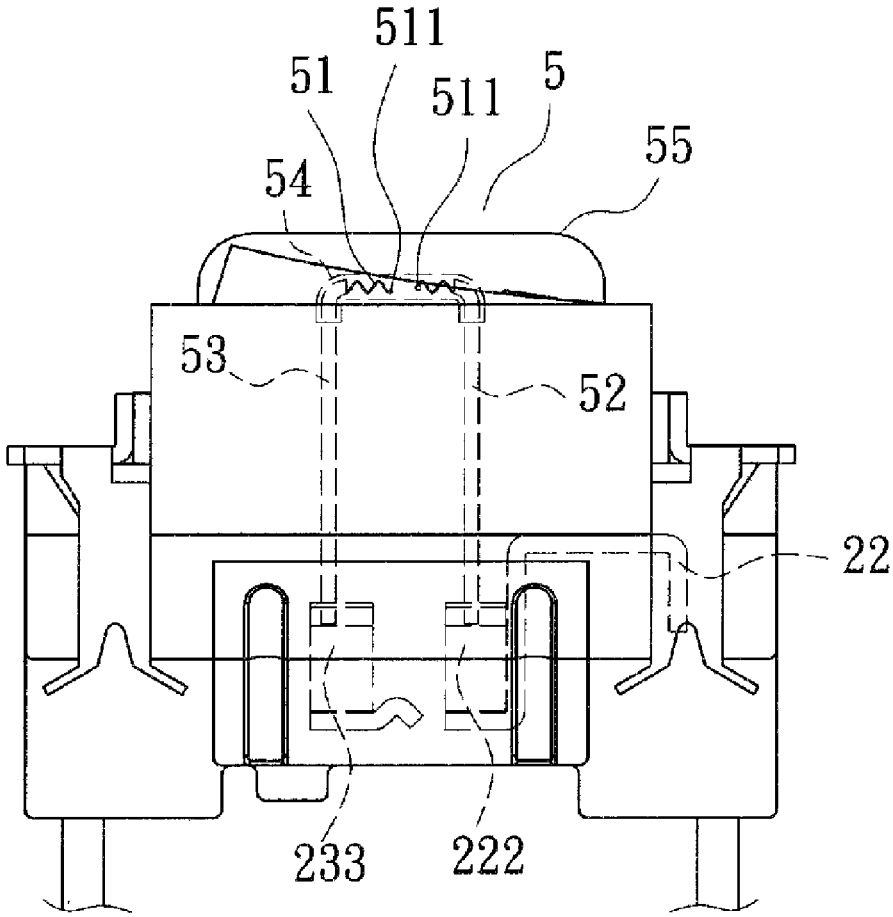
FIG. 6 is a cross-sectional view of the preferred embodiment in an open circuit, with a blown fuse in the safety module.
Figure 7:
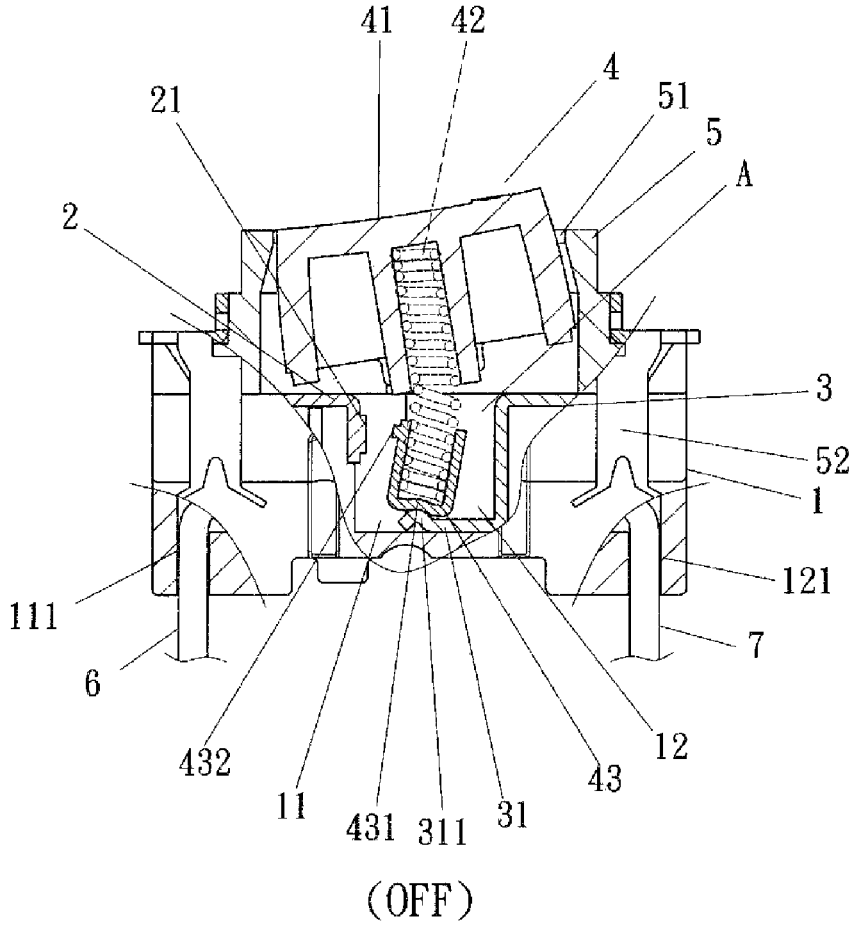
F I G . 7 (PRIOR ART)
FIG. 7 is a cross-sectional view of a prior art in an OFF mode.
Figure 8:
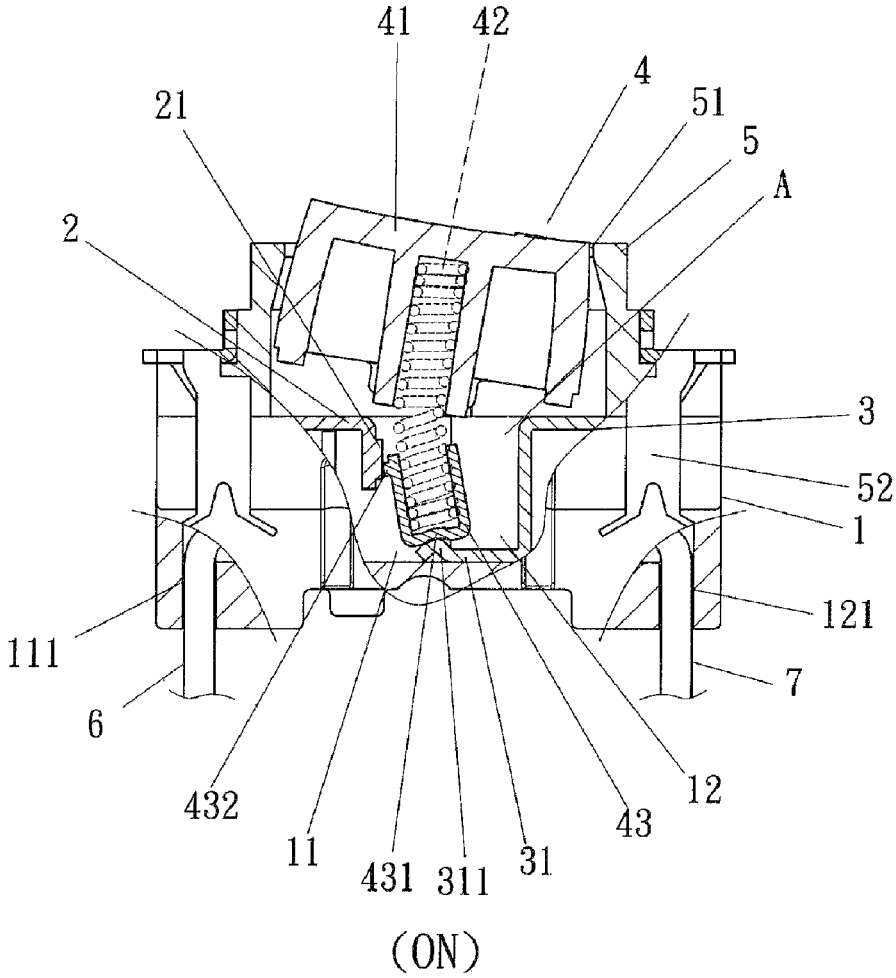
F I G . 8 (PRIOR ART)
FIG. 8 is a cross-sectional view of the prior art in FIG. 7 in an ON mode.

FIG. 6 shows an OFF mode of the preferred embodiment of this invention. In FIG. 6, the point 511 of the fuse 51 blows over an overload of currents under the heat-tolerant insulating sleeve 54 and the insulating fuse cover 55, achieving optimal insulation and safety concern.

The invention claimed is:

1. A wall switch with a current control module comprising:

a bottom seat, comprising a receiver with a partition space, and through-channels for external wires to go through;

a triple-conductors assembly, comprising a contact conductor, housed in said receiver and configured with a conductive first contact;

wired conductor, housed in said receiver and configured with a conductive top; and an bridge conductor, housed in said receiver and not contacting neither said contact conductor nor said wired conductor, and configured with a conductive head;

a press-button assembly, comprising a press block, and a conductor, housed in said partition space and configured with a conductive second contact adapted to said conductive first contact, with said conductor capable of moving with said press block;

a top cover, configured with two conductor insertions and an opening to pivotally receive said press block; and a current control safety module, comprising a fuse with a pre-set safety current threshold, and two conductive pillars for connection with said conductive top and conductive head, wherein each said conductive pillar is disposed on one end of said fuse through each of said two conductor insertions.

2. The wall switch with a current control module as claimed in claim 1, wherein said receiver comprises two compartments.

3. The wall switch with a current control module as claimed in claim 1, wherein said conductive top and said conductive head are configured on an extension extending along the floor of said bottom seat.

4. The wall switch with a current control module as claimed in claim 1, wherein a spiral spring is disposed between said press block and said conductor, a spring sleeve is configured underneath said press block to receive one end of said spiral spring, and said conductor is shaped like a U to receive the other end of said spiral spring.

5. The wall switch with a current control module as claimed in claim 1, wherein said current control safety module comprises a heat-tolerant and insulating fuse sleeve to clothe a part of said fuse and said conductive pillars, and said heat-tolerant and insulating fuse cover to clothe a part of said fuse sleeve and said conductive pillars.

* * * * *